US009253828B2

(12) United States Patent
Waser

(10) Patent No.: US 9,253,828 B2
(45) Date of Patent: Feb. 2, 2016

(54) CIRCUIT ARRANGEMENT AND METHOD FOR OPERATING LIGHT-EMITTING DIODES

(75) Inventor: Karl Georg Waser, Graz (AT)

(73) Assignee: AMS AG, Unterpremstatten (AT)

( * ) Notice: Subject to any disclaimer, the term of this patent is extended or adjusted under 35 U.S.C. 154(b) by 279 days.

(21) Appl. No.: 13/814,497

(22) PCT Filed: Jul. 28, 2011

(86) PCT No.: PCT/EP2011/063043

§ 371 (c)(1),
(2), (4) Date: Apr. 15, 2013

(87) PCT Pub. No.: WO2012/016910

PCT Pub. Date: Feb. 9, 2012

(65) Prior Publication Data

US 2013/0200800 A1 Aug. 8, 2013

(30) Foreign Application Priority Data

Aug. 6, 2010 (DE) ..... 10 2010 033 640

(51) Int. Cl.
*H05B 37/00* (2006.01)
*H05B 41/00* (2006.01)
*H05B 33/08* (2006.01)

(52) U.S. Cl.
CPC ..... *H05B 33/08* (2013.01); *H05B 33/0827* (2013.01)

(58) Field of Classification Search
USPC ..... 315/74, 88, 121
See application file for complete search history.

(56) References Cited

U.S. PATENT DOCUMENTS

| | | | | |
|---|---|---|---|---|
| 6,351,079 | B1 | 2/2002 | Willis | |
| 8,324,840 | B2 * | 12/2012 | Shteynberg et al. | 315/308 |
| 2003/0025120 | A1 | 2/2003 | Chang | |
| 2007/0080911 | A1 | 4/2007 | Liu et al. | |
| 2008/0054815 | A1 | 3/2008 | Kotikalapoodi et al. | |
| 2008/0094007 | A1 | 4/2008 | Liao et al. | |

(Continued)

FOREIGN PATENT DOCUMENTS

| | | | |
|---|---|---|---|
| CN | 101702849 | A | 5/2010 |
| DE | 10313246 | A1 | 10/2004 |

(Continued)

OTHER PUBLICATIONS

AS3682—460mA Flash/Backlight Driver, Jul. 8, 2010, austriamicrosystems AG, www.austriamicrosystems.at/eng/Products/Lighting-Management/Camera-Flash-LED-Drivers/AS3682.

(Continued)

*Primary Examiner* — Adam Houston
(74) *Attorney, Agent, or Firm* — McDermott Will & Emery LLP

(57) ABSTRACT

A circuit arrangement (11) for driving light-emitting diodes comprises a number N of current regulators (14, 15), which each comprise a control input (17, 19) and a load terminal (18, 20) for providing a load current (IL1, IL2) to an electrical load (12, 13) which can be coupled, in each case having a light-emitting diode (12', 13'). Furthermore, the circuit arrangement (11) comprises a compensation circuit (16), which is coupled to the control inputs (17, 19) of the number N of current regulators (14, 15) and is designed to adjust the respective load current (IL1, IL2) in a load-dependent manner.

14 Claims, 4 Drawing Sheets

(56) References Cited

U.S. PATENT DOCUMENTS

Figure 1A:
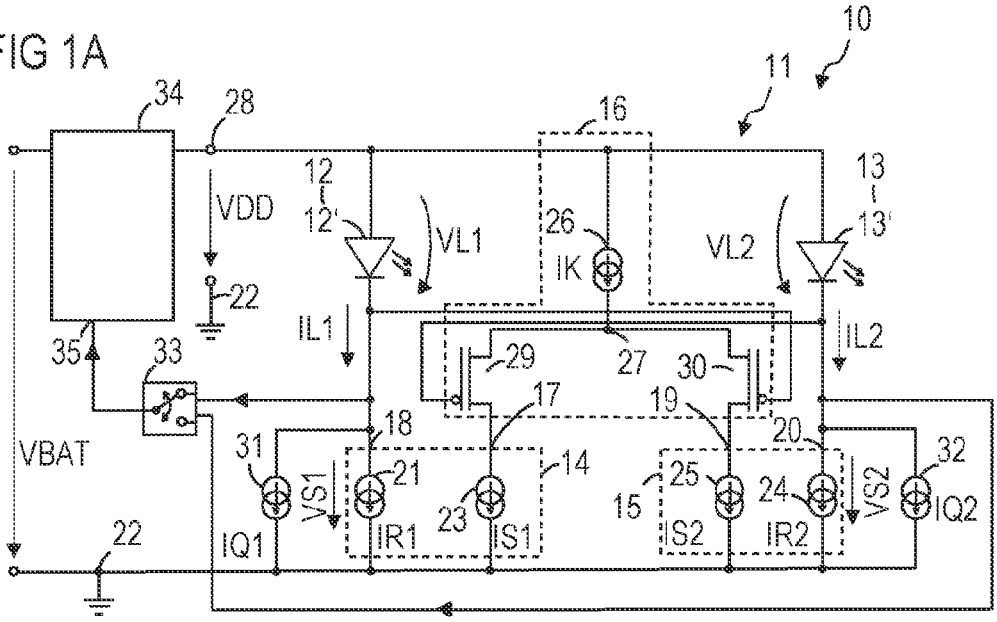

| | | | | |
|---|---|---|---|---|
| 2009/0079357 | A1* | 3/2009 | Shteynberg et al. | 315/291 |
| 2009/0212717 | A1 | 8/2009 | Trattler | |
| 2010/0013411 | A1 | 1/2010 | Krespach et al. | |
| 2012/0081009 | A1* | 4/2012 | Shteynberg et al. | 315/122 |
| 2012/0262075 | A1* | 10/2012 | Lynch et al. | 315/192 |
| 2013/0162156 | A1* | 6/2013 | Sutardja et al. | 315/201 |
| 2013/0200800 | A1* | 8/2013 | Waser | 315/121 |
| 2013/0342124 | A1* | 12/2013 | Huang et al. | 315/210 |
| 2014/0160609 | A1* | 6/2014 | Chen et al. | 361/86 |
| 2014/0246988 | A1* | 9/2014 | Chen | 315/223 |
| 2014/0300274 | A1* | 10/2014 | Acatrinei | 315/85 |
| 2015/0061528 | A1* | 3/2015 | Raval et al. | 315/210 |

FOREIGN PATENT DOCUMENTS

| | | | |
|---|---|---|---|
| DE | 102004034359 | B3 | 2/2006 |
| DE | 102006059355 | A1 | 6/2008 |
| DE | 102008030365 | A1 | 8/2009 |
| DE | 102008037551 | A1 | 5/2010 |
| EP | 1499165 | A2 | 1/2005 |
| WO | 01/01385 | A1 | 1/2001 |

OTHER PUBLICATIONS

AS3682 480mA Camera Lighting Management Unit, Revision 2. 1, austriamircosystems AG, 1997-2005, Unterpremstaetten, Austria.

* cited by examiner

CIRCUIT ARRANGEMENT AND METHOD FOR OPERATING LIGHT-EMITTING DIODES

The present invention relates to a circuit arrangement for operating light-emitting diodes, a lighting arrangement and a method for operating light-emitting diodes.

A light-emitting diode, abbreviated LED, is frequently operated by arranging a current source in series with the LED.

The document U.S. 2009/0212717 A1 deals with such a current source arrangement. Therein a number of load branches, each comprising a light-emitting diode and a current source, are arranged in parallel between an output of a voltage converter and a reference potential terminal. The power through each LED is held constant by the current source. The arrangement is designed to adjust the supply voltage in such a manner that it is sufficient for operating even the current source for which the voltage drop across the current source is the lowest. In this case, higher voltages drop across the other current sources, which lead to losses in the circuit arrangement.

An object of the present invention is to provide a circuit arrangement for operating LEDs, a lighting arrangement and a method for operating LEDs for which the efficiency of the energy utilization is increased.

The object is solved with the subject matter of claims 1 and 14.

Refinements and configurations are the subject matter of the dependent claims.

In one embodiment, a circuit arrangement for driving LEDs comprises a number N of current regulators. The current regulators each comprise a control input and a load terminal for providing a load current to an electrical load that can be coupled thereto. The electrical loads each comprise an LED. The circuit arrangement further comprises a compensation circuit that is coupled to the control inputs of the number N of current regulators and is designed to adjust the respective load current load-dependently.

A load current advantageously has a variable value and not a constant value. The load current for an LED that achieves a predetermined value of the load current only at higher voltages due to a manufacturing deviation or thermal influences can thus be reduced, so that a lower supply voltage is sufficient for operating the circuit arrangement. Forward voltages of LEDs, for example, have a wide scattering.

In one embodiment, the number N of current regulators each have a voltage difference across the respective current regulator that can be tapped. The compensation circuits adjust their respective load current so that the voltage differences are converged.

In one embodiment, at least two of the number N of voltage differences are converged toward one another.

In a refinement, the voltage differences are converged toward one another by the compensation circuit in such a manner that the difference of two voltage differences among the number N of voltage differences is reduced. The difference can have a value of zero after convergence of the voltage differences, so that two voltage differences are equalized. Alternatively, the difference can have a value not equal to zero, so that the two voltage differences are different even after convergence.

In a refinement, the voltage difference across the respective current regulator can be tapped between the load terminal of the respective current regulator and a supply terminal of the current regulator. The supply terminal is connected to a supply voltage terminal of the circuit arrangement or to a reference potential terminal of the circuit arrangement. The load terminal is connected to the respective electrical load. The first N current regulators are thus connected to the supply voltage terminal or to the reference potential terminal.

In one embodiment, the compensation circuit is designed to reduce the load current for that current regulator among the number N of current regulators that has the smallest voltage difference between the load terminal and the supply terminal of the current regulator. By reducing the load current for one current regulator, an increase of the voltage difference between the load terminal and the supply terminal of the current regulator can advantageously be achieved. If this takes place for the current regulator that has the smallest value of the voltage difference among the number N of current regulators, the value of the supply voltage can be reduced. Thereby the energy efficiency of the arrangement is increased.

In one embodiment, the compensation circuit is designed to increase the load current for that current regulator among the number N of current regulators that has the largest voltage difference between the load terminal and the supply terminal of the current regulator. If the load current is increased, then the voltage difference between the load terminal and the supply terminal of the respective current regulator is advantageously lowered. Depending on the current/voltage characteristic of a current regulator, the power in the current regulator can be reduced, for example, and thus the efficiency of energy usage by the current arrangement can be increased. The thermal load on the current regulator with the highest voltage difference is also reduced. In a refinement, the heat emitted by the electrical loads is also made more uniform, so that the thermal stress on the LEDs also decreases.

In one embodiment, the compensation circuit is designed to adjust the number N of current regulators in such a manner that the sum of the load currents is constant. The load currents flow through the load terminals of the number N of current regulators. The total current that flows through the number N of electrical loads advantageously remains constant. A compensation circuit has the effect that the load current through a first current regulator among the number N of current regulators is reduced if the load current through a second current regulator among the number N of current regulators is increased.

In one embodiment, the number N of current regulators are a total of two. Alternatively, the number N is at least two.

In a refinement, the circuit arrangement is automatically active. The circuit arrangement is autonomously and independently capable of carrying out the regulation of the number N of load currents.

The number N of current regulators can be implemented as a number N of current sources or as a number N of current sinks. The voltage difference can therefore be a current sink voltage. By means of the compensation circuit, it is thus possible for even the smallest current sink voltage to fall below a lower limit value even for the smallest possible supply voltage.

In one embodiment, a semiconductor body comprises the circuit arrangement. Preferably, exactly one semiconductor body can comprise the circuit arrangement. If the circuit arrangement also comprises a voltage converter, then the circuit arrangement can also comprise at least one capacitor or an inductor arranged outside the semiconductor body and coupled to the semiconductor body. The circuit arrangement can be realized efficiently in terms of space and cost.

In one embodiment, a lighting arrangement comprises the circuit arrangement and the number N of electrical loads. Each of the number N of electrical loads comprises at least one LED. At least one current regulator is connected in series to an electrical load. If an electrical load comprises at least two LEDs, then the at least two LEDs are arranged in series with one another.

In one embodiment, a method for driving LEDs comprises providing a number N of load currents to the number N of electrical loads. Each electrical load in this case comprises at least one LED. The method further comprises adjusting the respective load current based on the electrical load operated by the respective load current. The adjustment takes place during operation of the electrical loads.

The load current through the respective electrical load, which comprises at least one LED, is thus advantageously variable. Adjusting the number N of load currents can be conducted automatically.

In a refinement, the number N of load currents are provided by the number N of current regulators. A compensation circuit adjusts the respective load current. The adjustment can be performed by appropriate software, without an analog-digital converter and without a microprocessor. The regulation need not include a digital circuit. The regulation is done by means of an analog circuit.

In one embodiment, the respective load current is adjusted in such a manner that the voltage differences falling across the current regulators are converged.

In one embodiment, the load current is emitted by the respective current regulators. The load current flows through the respective current regulator. In order to converge the voltage differences dropping across the number N of current regulators towards one another, at least one of the load currents emitted by the number N of current regulators is modified, and thereby at least one of the voltage differences falling at the number N of current regulators is modified.

Figure 1B:
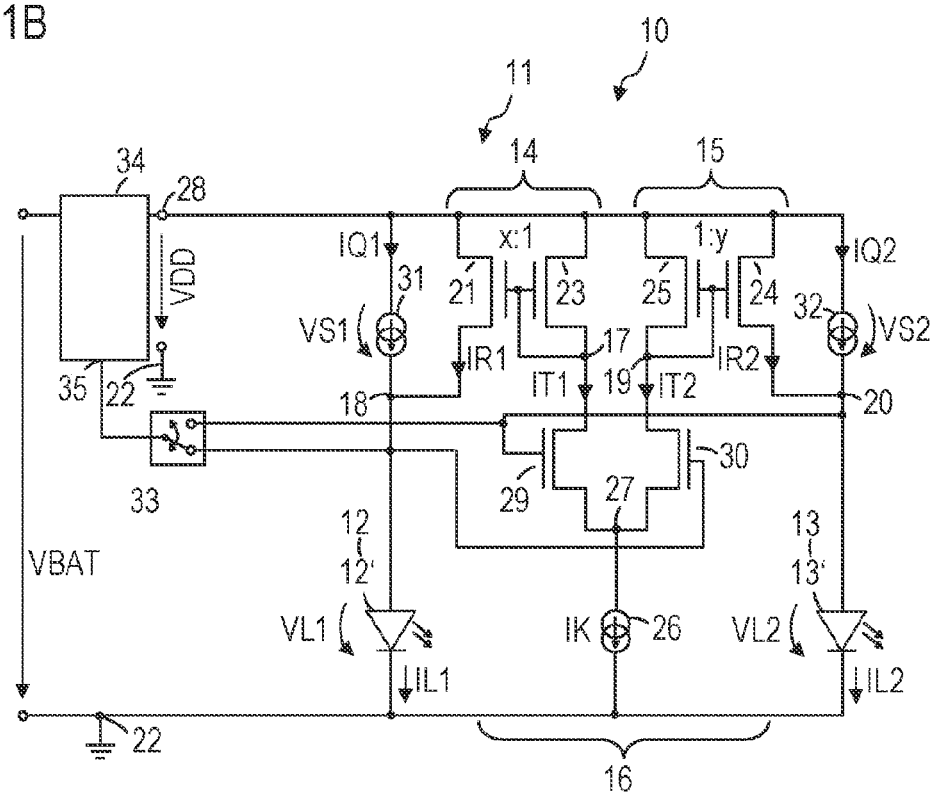
Figure 1C:
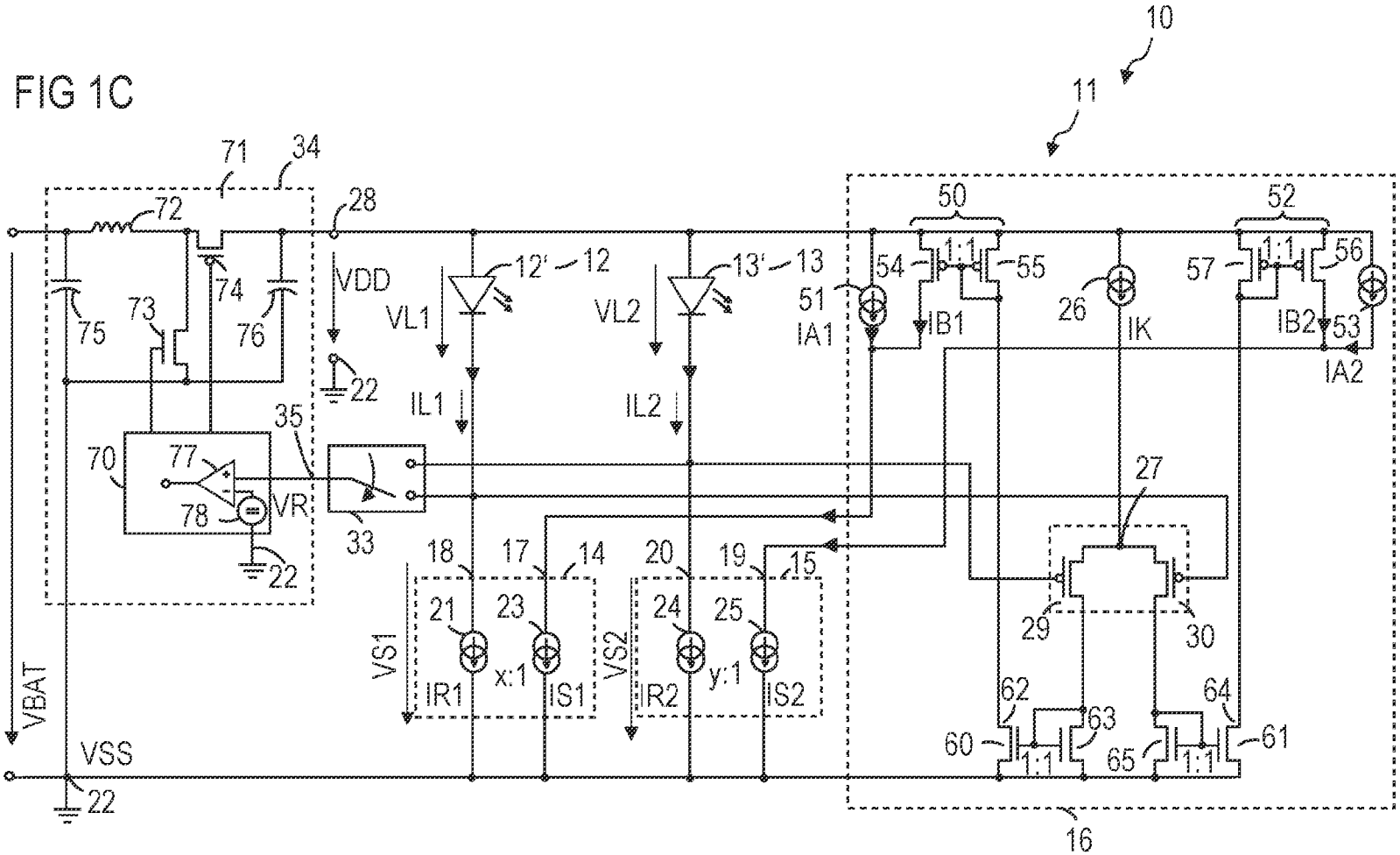
Figure 2:
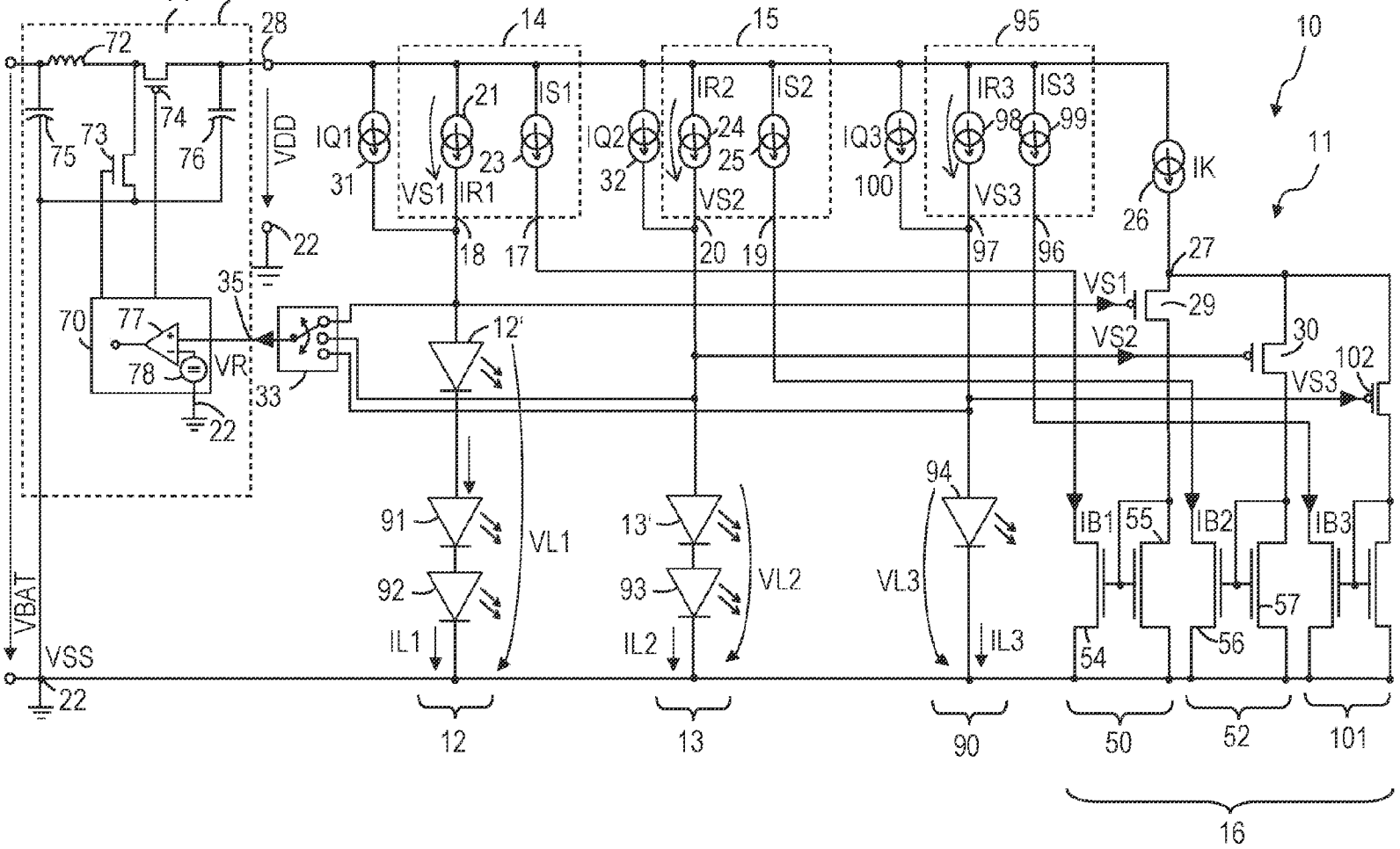
Figure 3:
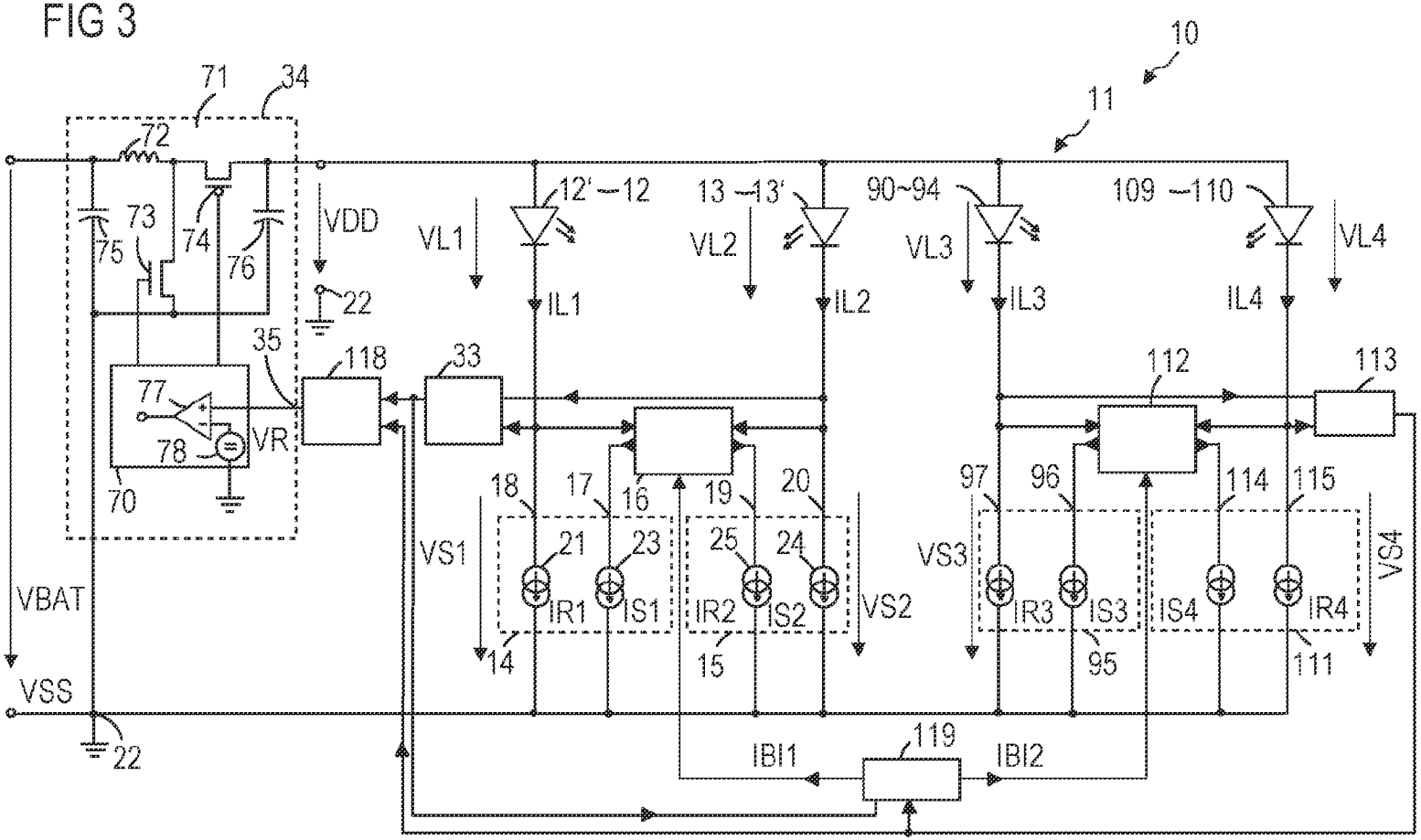

The invention will be described in detail below for several embodiment examples with reference to the figures. Components and circuit parts that are functionally identical or have the identical effect bear identical reference numbers. Insofar as circuit parts or components correspond to one another in function, a description of them will not be repeated in each of the following figures. Therein:

FIGS. 1A-1C show embodiment examples according to the proposed principle of a lighting arrangement with two loads, FIG. 2 shows an embodiment example of a lighting arrangement with three electrical loads, and FIG. 3 shows an embodiment example of a lighting arrangement with four electrical loads.

FIG. 1A shows an embodiment example of a lighting arrangement according to the proposed principle. The lighting arrangement 10 comprises a circuit arrangement 11 for driving LEDs, as well as a first and second electrical load 12, 13. The first and second electrical loads 12, 13 each comprise a light emitting diode 12', 13'. The circuit arrangement 11 comprises a number N of current regulators 14, 15 and a compensation circuit 16. The number N is two. A first current regulator 14 comprises a control input 17 and a load terminal 18. A second current regulator 15 comprises a control input 19 and a load terminal 20. A supply terminal of the first current source 14 and a supply terminal of the second current source 15 are connected to a reference potential terminal 22. The first electrical load 12 is connected to the load terminal 18 of the first current regulator 14. Correspondingly, the second electrical load 13 is connected to the load terminal 20 of the second current regulator 15. The first electrical load 12 is thus arranged in series with the controlled path of the first current regulator 14, and the second electrical load 13 is arranged in series with the controlled path of the second current regulator 15.

The compensation circuit 16 is connected to the control inputs 17, 19 of the first and second current regulators 14, 15. The first and the second current regulators 14, 15 are each realized as a current mirror. The first branch 21 of the current mirror of the first current regulator 14 connects the load terminal 18 of the first current regulator 14 to the reference potential terminal 22. Accordingly, a second branch 23 of the current mirror of the first current regulator 14 connects the control input 17 of the first current regulator 14 to the reference potential terminal 22. A first branch 24 of the current mirror of the second current regulator 15 further connects the load terminal 20 of the second current regulator 15 to the reference potential terminal 22. A second branch 25 of the current mirror of the second current regulator 15 further connects the control input 19 of the second current regulator to the reference potential terminal 22. The first and second branches 21, 23, 24, 25 are realized as current sources.

The control input 17 of the first current regulator 14 and the control input 19 of the second current regulator 15 are coupled to a summing node 27 of the compensation circuit 16. The compensation circuit 16 further comprises a first and a second transistor 29, 30. The control input 17 of the first current regulator 14 and the control input 19 of the second current regulator 15 are coupled to a summing node 27 of the compensation circuit 16 via the first and second transistors 29, 30. The compensation circuit 16 has a constant current source 26. The constant current source 26 is connected to the summing node 27. The constant current source 26 couples the summing node 27 to a supply voltage terminal 28. The first transistor 29 is arranged between the summing node 27 and the control input 17 of the first current regulator 14. The second transistor 30 connects the summing node 27 to the control input 19 of the second current regulator 15. A control terminal of the first transistor 29 is connected to the load terminal 20 of the second current regulator 15. A control terminal of the second transistor 30 is correspondingly connected to the load terminal 18 of the first current regulator 14.

The circuit arrangement 11 further comprises a first and a second current source 31, 32. The first current source 31 connects the load terminal 18 of the first current regulator 14 to the reference potential terminal 22. The second current source 32 correspondingly connects the load terminal 20 of the second current regulator 15 to the reference potential terminal 22. The circuit arrangement 11 further comprises a selection circuit 33. The selection circuit 33 is connected on the input side to the load terminals 18, 20 of the first and second current regulators 14, 15. The circuit arrangement 11 further comprises a voltage converter 34. An output of the voltage converter 34 is connected the supply voltage terminal 28. The selection circuit 33 is connected on the output side to a feedback input 35 of the voltage converter 34.

An input voltage VBAT is fed to the voltage converter 34. The input voltage VBAT drops between an input of the voltage converter 34 and the reference potential terminal 22. The voltage converter 34 converts the input voltage VBAT into a supply voltage VDD that is provided at the supply voltage terminal 28. The voltage converter 34 can be designed as an inductive or capacitive voltage converter. The voltage converter 34 can be designed to use one, two or three operating modes from a group comprising a buck operating mode, a boost operating mode and a buck-boost operating mode to convert the input voltage VBAT into a supply voltage VDD. The supply voltage VDD falls across a series circuit comprising a first electrical load 12 and the first current regulator 14 and over an additional series circuit comprising the second electrical load 13 and the second current regulator 15 according to the following equation:

$$VDD=VL1+VS1=VL2+VS2,$$

where VL1 is the load voltage dropping across the first electrical load 12, VS1 is the first voltage difference, dropping across the first current regulator 14, VL2 is the load voltage falling across the second electrical load 13 and VS2 is the second voltage difference, which drops across the second current regulator 15. The first voltage difference VS1 falls between the load terminal 18 of the first current regulator 14 and the supply terminal of the first current regulator 14. Correspondingly, the second voltage difference VS2 falls between the load terminal 20 of the second current regulator 15 and the supply terminal of the second current regulator 15. The first and second voltage differences VS1, VS2 are load-dependent, because according to the above equation, [they depend on the respective load voltages VL1, VL2. The first voltage difference VS1 dropping across the first branch 21 of the first current regulator 14 also drops across the first current source 31. Analogously, the second voltage difference VS2 dropping across the first branch 24 of the second current regulator 15 falls across the second current source 32. The first and second voltage differences VS1, VS2 are present between the load terminals 18, 20 of the first and second current regulators 14, 15, respectively, and the reference potential terminal 22.

The compensation circuit 16 routes a first control signal IS1 to the control input 17 of the first current regulator 14. Because the first current regulator 14 is realized as a current mirror, the first control signal IS1 is converted into a first current regulator current IR1. Accordingly, the compensation circuit 16 provides a second control signal IS2 at the control input 19 of the second current regulator 15. The second control signal IS2 is converted by the second current regulator 15, which is realized as current mirror, into a second current regulator current IR2. The conversion by the first and second current regulators 14, 15 is done in accordance with the following equations:

$$IR1=x\cdot IS1$$

and $$IR2=y\cdot IS2,$$

where x is the conversion factor of the first current regulator 14 and y is the conversion factor of the second current regulator 15. The first and second current regulators 14, 15 are adjusted so that the conversion factors x and y have the same value. A first current source current IQ1 flows through the first current source 31 and a second current source current IQ2 flows through the second current source 32. A first load current IL1 flows through the first electrical load 12. Correspondingly, a second load current IL2 flows through the second electrical load 13. The first and second load currents IL1, IL2 can be calculated according to the following equations:

$$IL1=IR1+IQ1$$

and $$IL2=IR2+IQ2,$$

The first voltage difference VS1, at the first branch 21 of the first current regulator 14, is supplied to the control terminal of the second transistor 30. Analogously, the second voltage difference, at the first branch 24 of the second voltage regulator 15, is supplied to the control terminal of the first transistor 29. The constant current source 26 provides a constant current IK. The constant current IK is distributed according to the following equation onto the first control signal IS1 and the second control signal IS2:

$$IK=IS1+IS2$$

The first and the second transistors 29, 30 are realized as p-channel field-effect transistors. If the first voltage difference VS1 is greater than the second voltage difference VS2, the second transistor 30 is put into a less conductive state compared to the first transistor 29. Consequently, the second control signal IS2 and correspondingly the second current regulator current IR2 decrease. The decrease of the second current regulator current IR2 leads to an increase of the second voltage difference VS2. Conversely, the value of the first control signal IS1, and consequently the value of the first load current IR1, increase. The first voltage difference VS1 consequently decreases. By virtue of the fact that the lower of the two voltage differences VS1, VS2, namely the second voltage difference VS2 in this example, increases and conversely the higher of the two voltage differences VS1, VS2, namely the first voltage difference VS1 in this example, decreases, the value of the supply voltage VDD that is sufficient for supplying the first and the second current regulators 14, 15 can be decreased. Thereby an increased efficiency of the energy usage of the input voltage VBAT is achieved.

Because the value of the constant current IK of the constant current source 26, as well as the first current source current IQ1 flowing through the first current source 31 and the second current source current IQ2 flowing through the second current source 32 each have constant values and the conversion factors x and y are identical, the sum of the first load current IL1 and the second load current IL2 is constant. The first current source 31 has the effect that the first load current IL1 is greater than or equal to a predetermined lower load current value. Correspondingly, the second current source 32 has the effect that the second load IL2 current is greater than or equal to a predetermined lower load current value. The first and the second load currents IL1, IL2 can advantageously be adjusted between predetermined current values. Thus the functioning of the first and second electrical loads 12, 13 is ensured, even in case of damage such as a line interruption.

The first and second voltage differences VS1, VS2 are fed to the selection circuit 33. The selection circuit 33 provides a signal at its output that corresponds to the lower value among the values of the first voltage difference VS1 and the second voltage difference VS2. This signal is fed to the feedback input 35 of the voltage converter 34. The voltage converter 34 is regulated according to the lower value of the first voltage difference VS1 or the second voltage difference VS2.

In an alternative embodiment, not shown, the first and second transistors 29, 30 are realized as n-channel field-effect transistors. In this case, the load terminal 18 of the first current regulator 14 is connected to the control terminal of the second transistor 30 and the load terminal 20 of the second current regulator 15 is connected to the control terminal of the first transistor 29.

In an alternative embodiment, not shown, the conversion factor x has a different value than the conversion factor y.

FIG. 1B shows an embodiment example of a lighting arrangement according to the proposed principal that is a refinement of the embodiment shown in FIG. 1A. According to FIG. 1B, the first and second electrical loads 12, 13 are connected to the reference potential terminal 22. Correspondingly, the first and second current regulators 14, and the first and second current sources 31, 32 are connected to the supply voltage terminal 28. The supply terminal of the first current regulator 14 and the supply terminal of the second current regulator 15 are connected to the supply voltage terminal 28. The first current regulator 14 and the first transistor 29 couple the supply voltage terminal 28 to the summing node 27. Analogously, the second current regulator 15 and the second transistor 30 couple the supply voltage terminal 28 to the summing node 27. The constant current source 26 couples the summing node 27 to the reference potential terminal 22. The first and second branches 21, 23 of the first current regulator 14 each comprise a transistor that is connected as a current mirror. The first and second branches 24, 25 of the second current regulator 15 likewise comprise a transistor that is connected as a current mirror. The first and second transistors 29, 30 are realized as n-channel field-effect transistors. A node between the first current regulator 14 and the first electrical load 12 is connected to the control terminal of the second transistor 30. Analogously, a node between the second current regulator 15 and the second electrical load 13 is connected to the control terminal of the first transistor 29.

The first and second voltage differences VS1, VS2 are present between the load terminals 18, 20 of the first and second current regulators 14, 15, respectively, and the supply potential terminal 28.

A first transistor current IT1 flows through the first transistor 29 and a second transistor current IT2 flows through the second transistor 30. The two transistors of the first and second branches 21, 23 of the first current regulator 14 are designed in such a manner that the current mirror of the first current regulator 14 has a conversion factor x. The value of the first current regulator current IR1 results from the value of the first transistor current IT1 according to the equation IR1=x*IT1. The two transistors of the first and second branches 24, 25 of the second current regulator 15 are designed in such a manner that the current mirror of the second current regulator 15 has a conversion factor y. The value of the second current regulator current IR2 results from the value of the second transistor current according to the equation IR2=y*IT2. The conversion factors x and y of the current mirrors for the first and second current regulators 14, 15 are greater than or equal to 1. The first and second electrical loads 12, 13 are thus operated with a mirrored first and a mirrored second load current IL1, IL2. The circuit arrangement 11 has the effect that the first load current IL1 is between a lower load current value and an upper predetermined load current value. Analogously, the second load current IL2 takes on values exclusively between the predetermined lower load current value and the predetermined upper load current value.

In an alternative embodiment, not shown, the first and second transistors 29, 30 are realized as p-channel field-effect transistors.

FIG. 1C shows an embodiment example of a lighting arrangement according to the proposed principal that is a refinement of the embodiments shown in FIGS. 1A and 1B. According to FIG. 1C, the first electrical load 12 is supplied exclusively by the first current regulator 14 and not additionally by the first current source 31. Correspondingly, the second electrical load 13 according to FIG. 1C is supplied exclusively by the second current regulator 15 and not additionally by the second current source 32. The compensation circuit 16 comprises a first compensation current mirror 50 and a first direct current source 51, which are connected in parallel to one another. The direct current source 51 is realized as a constant current source. The parallel connection of the first direct current source 51 and the first compensation current mirror couples the supply voltage terminal 28 to the control input 17 of the first current regulator 14. Correspondingly, the compensation circuit 16 comprises a second compensation current mirror 52 and a second direct current source 53, which are connected in parallel to one another. The parallel connection of the second direct compensation current mirror 52 and the second direct current source 53 couples the supply voltage terminal 28 to the control input 19 of the second current regulator 15.

The first compensation current mirror 50 comprises a first and a second compensation transistor 54, 55. The controlled path of the first compensation transistor 54 is arranged parallel to the first direct current source 51. The control terminal of the first compensation transistor 54 is connected to the control terminal of the second compensation transistor 55 and a first terminal of the second compensation transistor 55. A second terminal of the first and second compensation transistors 54, 55 is connected to the supply voltage terminal 28. The second compensation current mirror 52 comprises a third and a fourth compensation transistor 56, 57, which are arranged and connected analogously to the first and second compensation transistors 54, 55.

The compensation circuit 16 comprises a third and a fourth compensation current mirror 60, 61. The third compensation current mirror 60 couples the first compensation current mirror 50 to the first transistor 29. Correspondingly, the fourth compensation current mirror 61 couples the second compensation current mirror 52 to the second transistor 30. The third compensation current mirror 60 comprises a fifth and a sixth compensation transistor 62, 63. The controlled path of the fifth compensation transistor couples the reference potential terminal 22 to the controlled path of the second compensation transistor 55. The controlled path of the sixth compensation transistor 63 connects the reference potential terminal 22 to the first transistor 29. A control terminal of the fifth compensation transistor 62 is connected to a control terminal of the sixth compensation transistor 63 and to a node between the first transistor 29 and the sixth compensation transistor 63. Correspondingly, the fourth compensation current mirror 61 comprises a seventh and an eighth compensation transistor 64, 65, which are arranged and connected correspondingly to the fifth and the sixth compensation transistors 62, 63.

The first current regulator 14 is thus connected via the first and third compensation current mirrors 50, 60 and the first transistor 29 to the summing node 27. Correspondingly, the second current regulator 15 is connected via the second and the fourth compensation current mirrors 52, 65 and the second transistor 30 to the summing node 27.

The voltage regulator 34 comprises a control unit 70 and a voltage regulator circuit 71. The voltage regulator circuit 71 is realized as a boost regulator. The voltage regulator circuit 71 comprises an inductor 72 and a first and a second voltage regulator transistor 73, 74. The input of the voltage converter 34 is connected to a first terminal of the inductor 72. A second terminal of the inductor 72 is connected via the first voltage converter transistor 73 to the reference potential terminal 22, and via the second voltage converter transistor 74 to the output of the voltage converter 34 and thus to the voltage supply terminal 28. In addition, the voltage converter circuit 71 comprises a first and a second storage capacitor 75, 76, which connect the input or the output of the voltage converter circuit 71 to the reference potential terminal 22. The control unit 70 has an amplifier 77. A first input of the amplifier 77 is connected via the feedback input 35 to the output of the selection circuit 33. A second input of the amplifier 77 is connected via a reference voltage source 78 to the reference potential terminal 22. The amplifier 77 can be realized as a comparator.

The first and the second transistors 29, 30 are constructed as p-channel field-effect transistors. The load terminal 18 of the first current regulator 14 is coupled to the control terminal of the second transistor 30. Correspondingly, the load terminal 20 of the second current regulator 15 is coupled to the control terminal of the first transistor 29.

The parallel circuit of the first compensation current mirror 50 and the first direct current source 51 has the effect that the first load current IL1 is greater than or equal to the lower predetermined load current value. With the aid of the constant current source 26, this has the effect that the current value flowing through the first compensation current mirror 50 is less than or equal to the value of the constant current IK. This results in the first load current IL1 being less than or equal to the upper predetermined load current value. Analogously, the second load current IL2 takes on values exclusively between the predetermined lower load current value and the predetermined upper load current value.

If the first voltage difference VS1 is less than the second voltage difference VS2, then the current IT2 flowing through the second transistor 30 is greater than the current IT1 flowing through the first transistor 29. Therefore the second and the fourth compensation current mirrors 52, 65 have the effect that the second control signal IS2 and thus the second current regulator current IR2 increase and consequently lead to an increasing value of the second load current IL2. On the other hand, the current IT1 flowing through the first transistor 29 decreases, and consequently the first mirror current IB1 flowing through the first and the third compensation current mirrors 50, 60 decreases as well, and therefore the first current regulator current IR1 flowing through the first current regulator 14 decreases. The consequently decreasing first load current IL1 leads to an increase of the first voltage difference VS1. Thus, the first voltage difference VS1 is advantageously converged toward the second voltage difference VS2. Because the lower of the two voltage differences VS1, VS2 is raised and the upper of the two voltage differences VS1, VS2 is reduced, the value of the supply voltage VDD can be lowered. This leads to a reduction of the ohmic losses in the current regulator that has the higher value of voltage difference VS1, VS2.

The value of the first direct current IA1 that flows through the first direct current source 51 is identical to the value of the second direct current IA2 that flows through the second direct current source 53 and is constant. The value of the first direct current corresponds to a value IBIAS*(1−F), where IBIAS is the current value of a reference current source, not shown, and F is a factor that expresses the imbalance of the supply for the first electrical load 12 relative to the second electrical load 13. The factor F is fixedly adjusted in the circuit arrangement 11. Alternatively, the factor F can be adjustable during operation. The constant current IK and the first and second control signals IS1, IS2 can take on values in accordance with the following equations:

$$IK = I\mathrm{BIAS}\cdot 2\cdot F,$$

$$I\mathrm{BIAS}\cdot(1-F) \le IS1 \le I\mathrm{BIAS}\cdot(1+F) \text{ and}$$

$$I\mathrm{BIAS}\cdot(1-F) \le IS2 \le I\mathrm{BIAS}\cdot(1+F)$$

In one embodiment example, the imbalance factor is 10% or 0.1. The first and second load currents IL1, IL2 can thus take on values from the following ranges:

$$x\cdot I\mathrm{BIAS}\cdot(1-F) \le IL1 \le x\cdot I\mathrm{BIAS}\cdot(1+F) \text{ and}$$

$$y\cdot I\mathrm{BIAS}\cdot(1-F) \le IL2 \le y\cdot I\mathrm{BIAS}\cdot(1+F),$$

where x is the conversion factor of the current mirror of the first current controller 14, y is the conversion factor of the current mirror of the second current controller 15, F is the imbalance factor and IBIAS is the current value of a reference current source, not shown. Preferably, x=y. In this case, the sum of the two load currents IL1, IL2 is constant and results from the following equation:

$$IL1 + IL2 = x\cdot I\mathrm{BIAS}\cdot 2$$

The conversion factors x and y of the current mirrors for the first and second current regulators 14, 15 are greater than 1. The first and second electrical loads 12, are thus operated with a mirrored first and a mirrored second load current IL1, IL2. This has the effect that the currents that flow through the first and second compensation current mirrors 50, 52 and through the first and second current sources 51, 53 have only small values and therefore a high efficiency of energy usage is achieved.

On its output side, the selection circuit 33 provides the smaller value of the two values of the first and second voltage differences VS1, VS2 at the first input of the amplifier 77. The amplifier 77 compares the lower of the two voltage differences VS1, VS2 to a reference voltage value VR, which is provided by the reference voltage source 78. If the lower of the two voltage differences VS1, VS2 falls below the reference voltage value VR, then the control unit 70 drives the voltage converter circuit 71 in such a manner that the supply voltage VDD at the supply voltage terminal 28 rises. The value of the supply voltage VDD is raised until the value of the lower among the two voltage differences VS1, VS2 is greater than the reference voltage VR. For boost conversion, the first voltage converter transistor 73 and the second voltage converter transistor 74 are switched on alternately. If the first voltage converter transistor 73 is switched on in a first phase, then the value of the current flow through the inductor 72 increases. In a second phase, the first voltage converter transistor 73 is blocking and the second voltage converter transistor 74 is switched on. Due to the energy stored in the inductor 72, a current flows in the second phase to the second storage capacitor 76 and leads to an increase in the value of the output voltage VDD.

In an alternative embodiment, not shown, a buck converter or a buck-boost converter can be used in place of a boost converter. A capacitive voltage converter circuit can be formed in place of the inductive voltage converter circuit 71. The capacitive voltage converter circuit can be constructed as a boost, buck or boost/buck converter.

In an alternative embodiment, not shown, the first and second transistors 29, 30 are realized as n-channel field-effect transistors. The load terminal 18 of the first current regulator 14 is then connected to the control terminal of the first transistor 29, and the load terminal 20 of the second current regulator 15 is connected to the control terminal of the second transistor 30.

FIG. 2 shows an embodiment example of a lighting arrangement according to the proposed principal that is a refinement of the embodiments shown in FIGS. 1A-1C. The lighting arrangement 10 according to FIG. 2 comprises the first and second electrical loads 12, 13 as well as a third electrical load 90. The first electrical load 12 comprises the LED 12' and two additional LEDs 91, 92. The second electrical load 13 comprises the LED 13' and an LED 93. The third electrical load 90 comprises an LED 94. The third electrical load 90 is operated by a third current regulator 95. The third electrical load 90 is connected in series to the third current regulator 95. Differing from FIGS. 1A-1C, the first, second and third electrical loads 12, 13, 90 are connected to the reference potential terminal 22. Correspondingly, the first, second and third current regulators 14, 15, 95 are connected via their respective supply potential terminal to the supply voltage terminal 28. The first and second current sources 31, 32 connect the supply voltage terminal 28 to the load terminal 18 of the first current regulator 14 and the load terminal 20 of the second current regulator 15. In addition, a third current source 100 connects the supply voltage terminal 28 to a load terminal 97 of the third current regulator 95. Accordingly, the first, the second and a fifth compensation current mirror 50, 52, 101 are connected to the reference potential terminal 22.

The constant current source 26 couples the supply voltage terminal 28 to the summing node 27. The summing node is connected via the first transistor 29 to the first compensation current mirror 50, via the second transistor 30 to the second compensation current mirror 52, and via a third transistor 102 to the fifth compensation current mirror 101. The control terminal of the first transistor 29 is connected to the load terminal 18 of the first current regulator 14. In addition, the control terminal of the second transistor 30 is connected to the load terminal 20 of the second current regulator 15. Furthermore, the control terminal of the third transistor 102 is connected to the load terminal 97 of the third current regulator 95. The first, the second and the third transistors 29, 30, 102 are realized as p-channel field-effect transistors. The lighting arrangement 10 according to FIG. 2 thus has a number N of current regulators 14, 15, 95, the number N having the value three. A third voltage difference VS3 drops between a load terminal 97 of the third current regulator 95 and a supply terminal of the third current regulator 95, which is connected to the supply voltage terminal 28.

In an alternative embodiment, not shown, the circuit arrangement 11 comprises at least one additional current regulator for supplying at least one additional electrical load. The at least one additional current regulator can be constructed like the third current regulator 95. The at least one additional electrical load can be realized like the third electrical load 90. The compensation circuit 16 can have at least one additional branch, which comprises a transistor and a compensation current mirror.

FIG. 3 shows an embodiment example of a lighting arrangement that is a refinement of the embodiments shown in FIGS. 1A-1C and FIG. 2. The lighting arrangement 10 comprises the first and the second electrical loads 12, 13, the first and second current regulators 14, 15 and the compensation circuit 16 as shown in FIG. 1C. The third electrical load 90 as well as a fourth electrical load 109 are supplied by the third current regulator 95, a fourth current regulator 111 and a further compensation circuit 112, these being realized like the first and second current regulators 14, 15 and the compensation circuit 16. Whereas the electrical loads 12, 13, 95 in FIG. 2 are adjusted with respect to their load currents IL1, IL2 and IL3 in such a manner that as high an energy efficiency is possible is achieved, a compensation between the first and second electrical loads 12, 13 and between the third and fourth electrical loads 90, 110 is carried out in accordance with FIG. 3. Another selection circuit 113 couples the load terminals 97, 115 of the third and fourth current regulators 95, 111 to the voltage converter 34. The output of the selection circuit 33 and the output of the further selection circuit 113 are connected via an additional selection circuit 118 to the feedback input 35 of the voltage converter 34. The further selection circuit 113 and the additional selection circuit 118 are implemented like the selection circuit 33.

The circuit arrangement 11 further comprises a reference current source 119, which is connected on the output side to the compensation circuit 16 and the further compensation circuit 112. The reference current source 119 is connected to the constant current source 26 and the first and second direct current sources 51, 53, which are shown in FIG. 1C. Accordingly, the reference current source 119 can be connected to the constant current source 26 and the first, second and/or third current sources 31, 32, 100, which are shown in FIGS. 1A, 1B and 2. The reference current source 119 is connected to the input side to the output of the selection circuit 33 and the output of the further selection circuit 113.

The third voltage difference VS3 falls between the load terminal 97 of the third current regulator 95 and the supply terminal of the third current regulator 95, which is connected to the reference potential terminal 22. A fourth voltage difference VS4 falls between a load terminal 115 of the fourth current regulator 111 and a supply terminal of the fourth current regulator 111, which is connected to the reference potential terminal 22.

The reference current source 119 provides a first and a second reference current IBI1, IBI2. The first reference current IBI1 is used for generating the constant current IK of the first and second direct currents IA1, IA2 in the compensation circuit 16. The second reference current IBI2 is used for generating the constant current IK of the first and second direct currents in the compensation circuit 112. The reference current source 119 can be realized similarly to the compensation circuit 16. The reference current source 119 provides the first and the second reference currents IBI1, IBI2 as a function of the signals at the outputs of the selection circuit 33 and the further selection circuit 113. The circuit arrangement 11 is used for cascaded supply of the electrical loads 12, 13, 90, 109. It generates the constant currents in the compensation circuit and the further compensation circuit 112 in a cascaded manner.

In an alternative embodiment, not shown, the lighting arrangement comprises additional electrical loads, which are combined in pairs and operated by means of current regulators and at least one additional compensation circuit. For example, four additional electrical loads like the first, second, third and fourth electrical loads 12, 13, 90, 109 can be supplied. An additional reference current source can control the four current regulators for the four additional loads. An additional reference current source can in turn control the reference current source 119 and the additional reference current source.

The circuit arrangement 11 can be designed in such a manner that it provides the respective load currents IL1, IL2, IL3, IL4 for the number N of electrical loads 12, 13, 90, 109 in a cascaded manner, where N=2M.

A high efficiency of energy utilization can be achieved with the lighting arrangement 10 according to FIG. 3. For example, if the first and the second electrical loads 12, 13 require markedly higher load currents due to their construction than the third and the fourth electrical loads 94, 109, a better lighting effect can be achieved with an arrangement according to FIG. 3 than would be possible by connecting the four electrical loads 12, 13, 90, 109 via a summing node 27.

The parallel connection of the electrical loads advantageously has the effect that the four load currents IL1, IL2, IL3, IL4 can assume only values in the predetermined ranges and therefore can only differ from one another within a narrow range. A markedly higher homogeneity of lighting is advantageously achieved by means of the LEDs 12', 13', 94, 110.

LIST OF REFERENCE NUMBERS

10 Lighting arrangement
11 Circuit arrangement
12 First electrical load
12' LED
13 Second electrical load
13' LED

14 First current regulator
15 Second current regulator
16 Compensation circuit
17 Control input
18 Load terminal
19 Control input
20 Load terminal
21 First branch
22 Reference potential terminal
23 Second branch
24 First branch
25 Second branch
26 Constant current source
27 Summing node
28 Supply voltage terminal
29 First transistor
30 Second transistor
31 First current source
32 Second current source
33 Selection circuit
34 Voltage converter
35 Feedback input
50 First compensation current mirror
51 First direct current source
52 Second compensation current mirror
53 Second direct current source
54 First compensation transistor
55 Second compensation transistor
56 Third compensation transistor
57 Fourth compensation transistor
60 Third compensation current mirror
61 Fourth compensation current mirror
62 Fifth compensation transistor
63 Sixth compensation transistor
64 Seventh compensation transistor
65 Eighth compensation transistor
70 Controller circuit
71 Voltage converter circuit
72 Inductor
73 First voltage converter transistor
74 Second voltage converter transistor
75, 76 Storage capacitor
77 Amplifier
78 Reference voltage source
90 Third electrical load
91, 92, 93, 94 LED
95 Third current regulator
96 Control input
97 Load terminal
100 Third current source
101 Fifth compensation current mirror
102 Third transistor
109 Fourth electrical load
110 LED
111 Fourth current regulator
112 Further compensation circuit
113 Further selection circuit
114 Control input
115 Load terminal
118 Additional selection circuit
119 Reference current source
IA1 First direct current
IA2 Second direct current
IB1 First mirror current
IB2 Second mirror current
IB3 Third mirror current
IBIAS Reference current
IBI1 First reference current
IBI2 Second reference current
IK Constant current
IL1 First load current
IL2 Second load current
IL3 Third load current
IL4 Fourth load current
IS1 First control signal
IS2 Second control signal
IS3 Third control signal
IS4 Fourth control signal
IQ1 First current source current
IQ2 Second current source current
IQ3 Third current source current
IR1 First current regulator current
IR2 Second current regulator current
IR3 Third current regulator current
IR4 Fourth current regulator current
IT1 First transistor current
IT2 Second transistor current
VBAT Input voltage
VDD Supply voltage
VL1 First load voltage
VL2 Second load voltage
VL3 Third load voltage
VL4 Fourth load voltage
VR Reference voltage
VSS Reference potential
VS1 First voltage difference
VS2 Second voltage difference
VS3 Third voltage difference
VS4 Fourth voltage difference
x Conversion factor
y Conversion factor

The invention claimed is:

1. A circuit arrangement for driving light emitting diodes, comprising:

a number N of current regulators each comprising a control input and a load terminal for providing a load current to an electrical load that can be coupled thereto, each load comprising a light emitting diode and each current regulator having a voltage difference across the respective current regulator that can be tapped; and a compensation circuit comprising a constant current source and a summing node that is coupled to the control inputs of the number N of current regulators and is connected via the constant current source to a supply voltage terminal or a reference potential terminal, wherein the compensation circuit is designed to adjust the respective load current in such a manner that the voltage differences are converged.

2. The circuit arrangement according to claim 1, wherein the voltage difference that can be tapped across the respective current regulator can be tapped between the load terminal of the respective current regulator and a supply terminal of the respective current regulator.

3. The circuit arrangement according to claim 1 or 2, wherein the compensation circuit is designed to reduce the load current for the current regulator among the number N of current regulators that has the smallest voltage difference between the load terminal and a supply terminal of the current regulator.

4. The circuit arrangement according to claim 1, wherein the compensation circuit is designed to increase the load current for the current regulator among the number N of current regulators that has the largest voltage difference between the load terminal and a supply terminal of the current regulator.

5. The circuit arrangement according to claim 1, wherein the compensation circuit is designed to adjust the number N of current regulators in such a manner that the sum of the load currents that flow through the load terminals of the number N of current regulators is constant.

6. The circuit arrangement according to claim 1, wherein the first number N of current regulators and the compensation circuit are designed in such a manner that the respective load current, that flows through an electrical load of the number N of electrical loads is greater than or equal to a predetermined lower load current value.

7. The circuit arrangement according to claim 1, wherein the first number N of current regulators and the compensation circuit are designed in such a manner that the respective load current that flows through an electrical load of the number N of electrical loads is less than or equal to a predetermined upper load current value.

8. The circuit arrangement according to claim 1, the compensation circuit comprising the number N of transistors, a respective transistor being arranged between a control input of the number N of current regulators and the summing node, and the transistor being connected on the control side to the load terminal of a current regulator among the first number N of current regulators.

9. The circuit arrangement according to claim 1, wherein the at least one current regulator among the number N of current regulators is designed as a current mirror that is connected to the load terminal of the respective current regulator and the control input of the respective current regulator.

10. The circuit arrangement according to claim 9, the compensation circuit comprising the number N of control circuits, each comprising a direct current source and a compensation current mirror, a first branch of the compensation current mirror and the direct current source being arranged in parallel to one another and between a supply voltage terminal or a reference potential terminal and the control input of the associated current regulator, and a second branch of the compensation current mirror being coupled to the summing node.

11. The circuit arrangement according to claim 1, comprising a selection circuit that is connected on the input side to the load terminals of the number N of current regulators and is designed to provide a feedback signal at its output that depends on the smallest voltage difference between the load terminal and a supply terminal of the current regulator.

12. The circuit arrangement according to claim 1, comprising a voltage converter that is designed for electrical supply of the number N of the regulators, the electrical loads that can be coupled thereto and the compensation circuit.

13. A lighting arrangement, comprising the circuit arrangement according to claim 1 and the number N of electrical loads, wherein a respective current regulator among the number N of current regulators is connected to an electrical load among the number N of electrical loads and each electrical load among the number N of electrical loads comprises at least one light emitting diode.

14. A method for driving light emitting diodes, comprising:

providing a number N of load currents by means of the number N of current regulators to the number N of electrical loads, each comprising at least one light emitting diode; and adjusting the respective load current based on the electrical load operated by the respective load current during the operation of the electrical loads by a compensation circuit in such a manner that the voltage differences dropping across the current regulators are converged, wherein the control inputs of the number N of current regulators are coupled to a summing node of the compensation circuit and a constant current source of the compensation circuit couples the summing node to a supply voltage terminal or a reference potential terminal.

* * * * *